US007326082B2

(12) United States Patent
Sharf

(10) Patent No.: US 7,326,082 B2
(45) Date of Patent: Feb. 5, 2008

(54) ELECTRICAL CONNECTOR

(75) Inventor: Alex Michael Sharf, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/284,059

(22) Filed: Nov. 21, 2005

(65) Prior Publication Data

US 2007/0117461 A1 May 24, 2007

(51) Int. Cl.
*H01R 13/648* (2006.01)

(52) U.S. Cl. ..... 439/608

(58) Field of Classification Search ..... 439/608, 439/79, 609

See application file for complete search history.

(56) References Cited

U.S. PATENT DOCUMENTS 5,066,236 A 11/1991 Broeksteeg
5,104,341 A 4/1992 Gilissen et al.
5,342,211 A 8/1994 Broeksteeg
5,496,183 A 3/1996 Soes et al.
5,795,191 A 8/1998 Preputnick et al.
6,347,962 B1 2/2002 Kline
6,461,202 B2 10/2002 Kline
6,471,549 B1 10/2002 Lappohn
6,592,381 B2 * 7/2003 Cohen et al. ..... 439/80
6,602,095 B2 * 8/2003 Astbury et al. ..... 439/608
6,652,327 B2 * 11/2003 Lau et al. ..... 439/717
6,808,420 B2 10/2004 Whiteman, Jr. et al.

* cited by examiner

*Primary Examiner*—Phuong Dinh

(57) ABSTRACT

An electrical connector includes a housing, and first and second contact modules mounted proximate one another in the housing. The first and second contact modules each include a mating edge and a mounting edge, and the first and second contact modules each include a lead frame having terminals extending between the mating edge and the mounting edge. The first and second contact modules each encase corresponding terminals, and the first and second contact modules each have contact side surfaces that face one another when mounted in the housing. The side surface of the first contact module includes a void positioned therein and exposing the lead frame, and the side surface of the second contact module includes a protrusion extending outward therefrom. The void and the protrusion are aligned with one another such that the protrusion is received in the void when the first and second contact modules are mounted in the housing.

15 Claims, 11 Drawing Sheets

ELECTRICAL CONNECTOR

BACKGROUND OF THE INVENTION

This invention relates generally to high speed electrical connectors, and more particularly, to electrical connectors having contact module plugging structures.

With the ongoing trend toward smaller, faster, and higher performance electrical components such as processors used in computers, routers, switches, etc., it has become increasingly important for the electrical interfaces along the electrical paths to also operate at higher frequencies and at higher densities with increased throughput.

In a traditional approach for interconnecting circuit boards, one circuit board serves as a back plane and the other as a daughter board. The back plane typically has a connector, commonly referred to as a header, that includes a plurality of signal pins or contacts which connect to conductive traces on the back plane. The daughter board connector, commonly referred to as a receptacle, also includes a plurality of contacts or pins. Typically, the receptacle is a right angle connector that interconnects the back plane with the daughter board so that signals can be routed therebetween. The right angle connector typically includes a mating face that receives the plurality of signal pins from the header on the back plane, and contacts that connect to the daughter board.

At least some right angle connectors include a plurality of contact modules that are received in a housing. The contact modules typically include a lead frame encased in a dielectric body. The body is manufactured using an over-molding process. However, because the terminals of the lead frame tend to move and shift position during the molding process, the terminals are typically held in place during the molding process by securing members or fingers. When the securing members are removed, voids or pinch points remain in the body of the contact modules. The voids expose, to air, at least a portion of the terminals of the lead frame. The exposed portion of the terminals may introduce signal degradation, particularly in signals transmitted at high frequency.

Some older connectors, which are still in use today, operate at speeds of less than one gigabit per second. By contrast, many of today's high performance connectors are capable of operating at speeds of up to ten gigabits or more per second. The signal degradation caused by the voids in the contact modules are becoming a problem in the high performance connectors in use today.

A need remains for a low cost connector with improved electrical characteristics such as reduced signal degradation and increased throughput.

BRIEF DESCRIPTION OF THE INVENTION

In one aspect, an electrical connector is provided including a housing, and first and second contact modules mounted proximate one another in the housing. The first and second contact modules each include a mating edge and a mounting edge, and the first and second contact modules each include a lead frame having terminals extending between the mating edge and the mounting edge. The first and second contact modules each encase corresponding terminals, and the first and second contact modules each have contact side surfaces that face one another when mounted in the housing. The side surface of the first contact module includes a void positioned therein and exposing the lead frame, and the side surface of the second contact module includes a protrusion extending outward therefrom. The void and the protrusion are aligned with one another such that the protrusion is received in the void when the first and second contact modules are mounted in the housing.

Optionally, the side surfaces are aligned in parallel planes, and the protrusions extend perpendicular to the parallel planes. The side surfaces may abut against one another. In one embodiment, multiple voids are provided on the side surface of the first contact module and multiple protrusions are provided on the side surface of the second contact module. Optionally, the side surface of the first contact module may include a set of voids and a set of protrusions arranged in a first pattern, and the side surface of the second contact module may include a set of voids and a set of protrusions arranged in a second pattern that is different than the first pattern. The first contact module may include opposed first and second side surfaces, and the second contact module may include opposed first and second side surfaces, wherein each of the first side surfaces include a set of voids and a set of protrusions arranged in a first pattern, and each of the second side surface include a set of voids and a set of protrusions arranged in a different second pattern. The first side surface of the first contact module may face the second side surface of the second contact module such that each void is substantially filled by a corresponding protrusion when the contact modules are mounted within the housing.

In another aspect, an electrical connector is provided including a housing and contact modules mounted in the housing. Each contact module includes a mating edge and a mounting edge, and each the contact module includes a lead frame having terminals extending between the mating edge and the mounting edge. Each contact module encases corresponding terminals, and each contact module includes a contact side surface having a void positioned therein and exposing the lead frame. An insert member includes opposed side surfaces each having a protrusion extending outward therefrom, and the insert member is positioned between adjacent contact modules such that each protrusion is received in a corresponding void when the contact modules and the insert member are mounted in the housing.

In a further aspect, a contact module is provided for an electrical connector, wherein the contact module includes a lead frame having a mating edge and a mounting edge. The lead frame includes terminals extending between the mating edge and the mounting edge. The contact module also includes a dielectric body having opposing first and second side surfaces, wherein the terminals are positioned between the first and second side surfaces. The first side surface includes a void positioned therein and exposing the lead frame, and the second side surface includes a protrusion extending outward from the second side surface. The void is configured to be at least partially filled by a corresponding protrusion of an adjacent contact module when arranged within the electrical connector, and the protrusions is configured to at least partially fill a corresponding void of an adjacent contact module when arranged within the electrical connector.

DETAILED DESCRIPTION OF THE INVENTION

Figure 1:
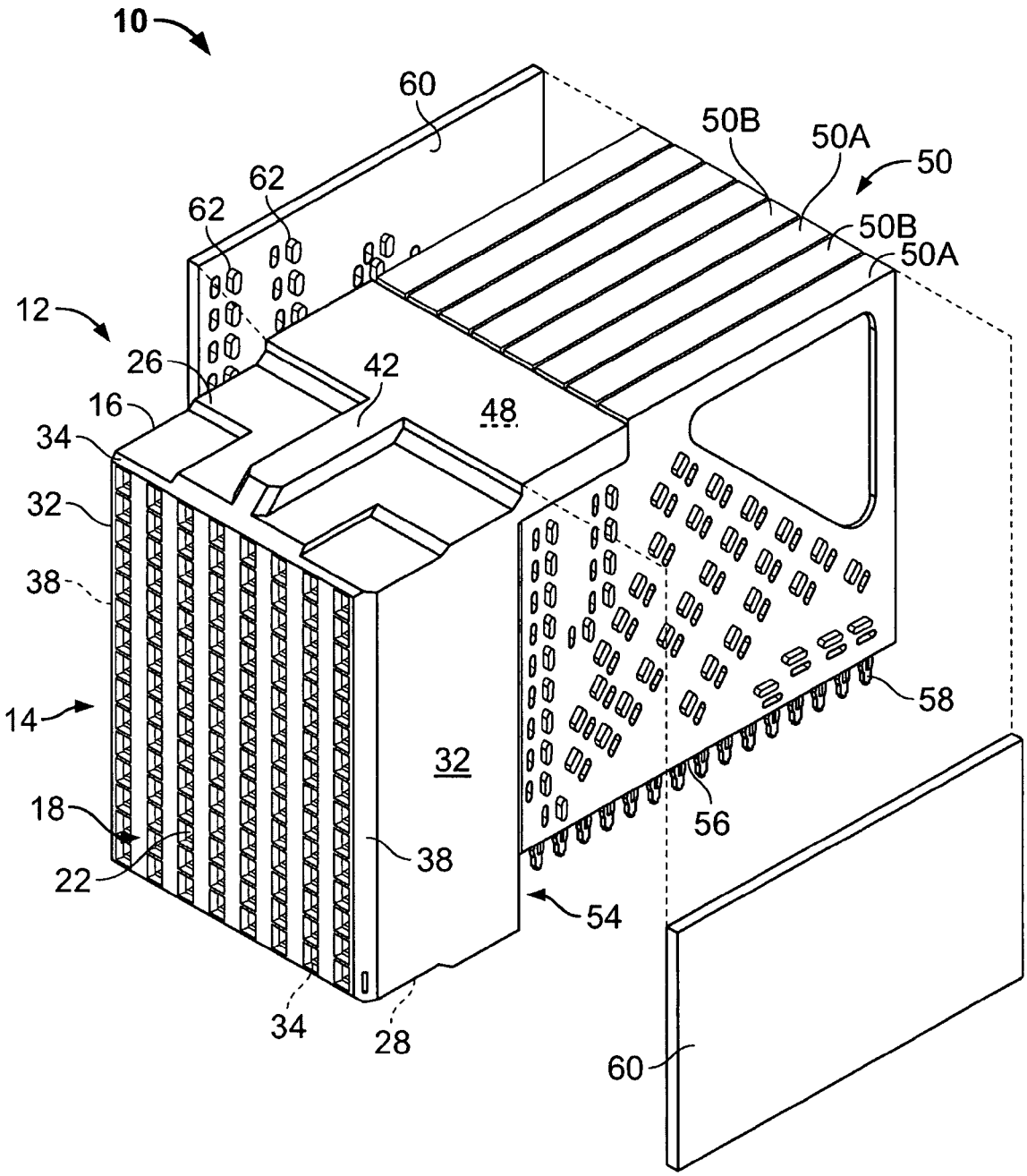
FIG. 1 is a perspective view of an electrical connector formed in accordance with an exemplary embodiment of the present invention.

FIG. 1 illustrates an electrical connector 10 formed in accordance with an exemplary embodiment of the present invention. While the connector 10 will be described with particular reference to a receptacle connector, it is to be understood that the benefits herein described are also applicable to other connectors in alternative embodiments. The following description is therefore provided for purposes of illustration, rather than limitation, and is but one potential application of the inventive concepts herein.

The connector 10 includes a dielectric housing 12 having a forward mating end 14 that includes a shroud 16 and a mating face 18. The mating face 18 includes a plurality of mating contacts 20 (shown in FIG. 3), such as, for example, contacts within contact cavities 22, that are configured to receive corresponding mating contacts (not shown) from a mating connector (not shown). The shroud 16 includes an upper surface 26 and a lower surface 28 between opposed sides 32. The upper and lower surfaces 26 and 28, respectively, each includes a chamfered forward edge 34. The sides 32 each include chamfered side edges 38. An alignment rib 42 is formed on the upper shroud surface 26 and lower shroud surface 28. The chamfered edges 34 and 38 and the alignment ribs 42 cooperate to bring the connector 10 into alignment with the mating connector during the mating process so that the contacts in the mating connector are received in the contact cavities 22 without damage.

The housing 12 also includes a rearwardly extending hood 48. A plurality of contact modules 50 are received in the housing 12 from a rearward end 54. The contact modules 50 define a connector mounting face 56. The connector mounting face 56 includes a plurality of contacts 58, such as, for example, pin contacts, or more particularly, eye-of-the-needle-type contacts, that are configured to be mounted to a substrate (not shown), such as a circuit board. In an exemplary embodiment, the mounting face 56 is substantially perpendicular to the mating face 18 such that the connector 10 interconnects electrical components that are substantially at a right angle to one another. In one embodiment, the contact modules 50 include two module types, 50A and 50B (shown in FIGS. 5-8) as will be described. Alternatively, the contact module 50 may include a single module type, such as the contact module 50C (shown in FIGS. 9 and 10) or the contact module 50D (shown in FIG. 11), as will be described in detail below. In other alternative embodiments, more than two contact module types may be used.

Optionally, the housing 12 may include side walls 60 extending from the rearward end 54 of the housing 12. The side walls 60 extend along the outer contact modules 50. A plurality of protrusions 62 extend from the side walls 60 toward the contact modules and engage the contact modules 50. The side walls 60 may be attached to the housing 12 in a conventional manner. Alternatively, the side walls 60 may be integrally formed with the housing 12.

Figure 2:
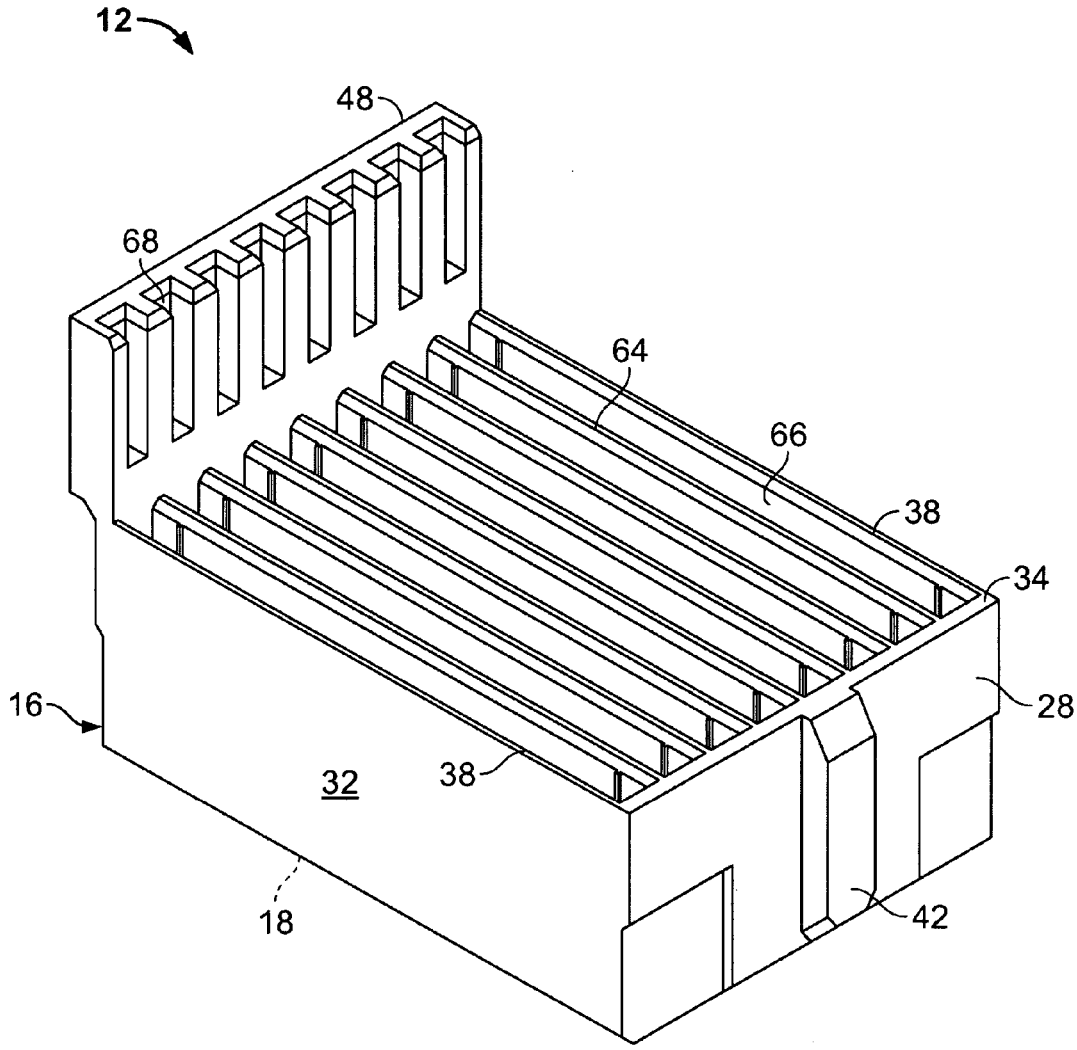
FIG. 2 is a rear perspective view of a housing of the electrical connector shown in FIG. 1.

FIG. 2 illustrates a rear perspective view of the housing 12. The housing 12 includes a plurality of dividing walls 64 that define a plurality of chambers 66. The chambers 66 receive a forward portion of the contact modules 50 (FIG. 1). A plurality of slots 68 are formed in the hood 48. The chambers 66 and slots 68 cooperate to stabilize the contact modules 50 when the contact modules 50 are loaded into the housing 12. In one embodiment, the chambers 66 and slots 68 extend substantially an entire length of the contact modules 50 (FIG. 1) such that the chamber walls separate adjacent contact modules 50.

Figure 3:
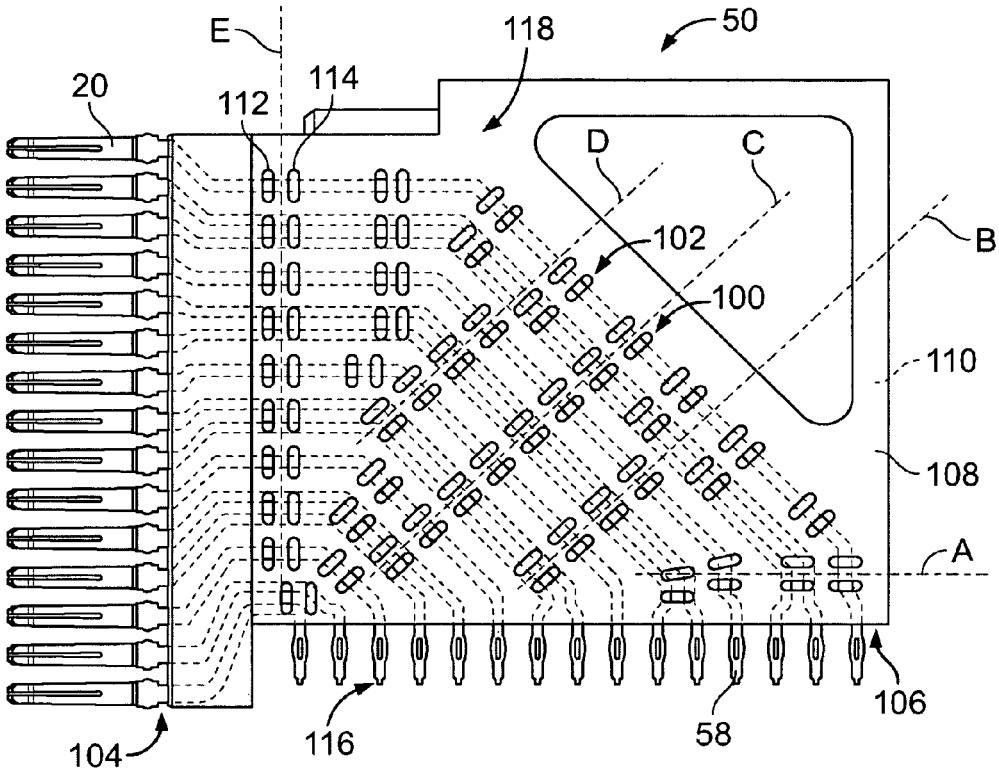
FIG. 3 is a side view of a contact module used with the electrical connector shown in FIG. 1, and showing lead paths in phantom outline.
Figure 4:
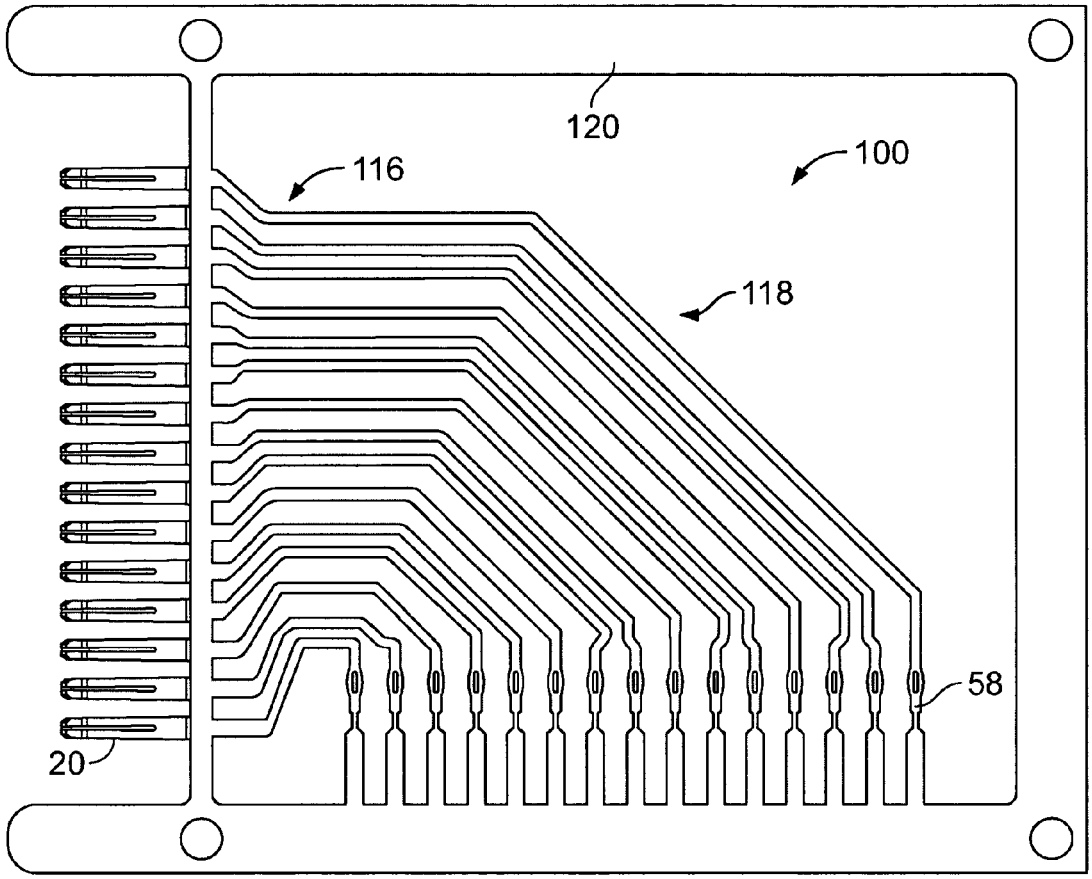
FIG. 4 is a side view of a lead frame for the contact module shown in FIG. 3 and held within a carrier strip.

FIG. 3 illustrates the contact module 50 that includes an internal lead frame 100, shown in phantom outline, and a dielectric body 102. FIG. 4 illustrates the lead frame 100 that is held within the contact module 50. The body 102 is fabricated from a dielectric material, such as a plastic material, and encases the lead frame 100. The mating contacts 20 extend from a mating edge 104 of the body 102 and the mounting contacts 58 extend from a mounting edge 106 of the body 102. The body 102 includes opposed first and second planar side surfaces 108 and 110, respectively. The side surfaces 108 and 110 extend substantially parallel to and along the lead frame 100.

In one embodiment, the body 102 is manufactured using an over-molding process. During the molding process, the lead frame 100 is encased in a dielectric material, such as a plastic material, which forms the body 102. However, during the molding process, voids or apertures 112 are created, which extend through the first and/or second surfaces 108 and/or 110. The voids 112 extend to the lead frame 100 such that the lead frame 100 is exposed through the voids 112. During the molding process, a plugging structure is provided on the contact module 50. Optionally, the plugging structure may include protrusions or arms 114 that extend outward from the first and/or second surfaces 108 and/or 110. Optionally, the protrusions 114 extend perpendicular with respect to the surfaces 108 and/or 110.

As illustrated in FIG. 3, the first side surface 108 includes both protrusions 114 and voids 112 arranged in a predetermined pattern. Alternatively, the first side surface 108 may include one of protrusions 114 and voids 112. The protrusions 114 and voids 112 may be circular, rectangular, triangular, elliptical, and the like. Optionally, the protrusions 114 and voids 112 may be tapered or chamfered to facilitate mating adjacent contact modules 50. In one embodiment, the protrusions 114 and voids 112 may be aligned in rows that extend parallel to the mating edge 104 or the mounting edge 106, or that extend oblique with respect to the mating or mounting edges 104 or 106. In FIG. 3, the protrusions 114 and voids 112 are illustrated as being elliptical and are aligned along axes (e.g. A-D). The particular patterns and orientation of protrusions 114 and voids 112 will be explained below in more detail, and are not limited to the patterns and orientations illustrated in these figures.

The lead frame 100 includes a plurality of terminals 116 that extend along predetermined paths to electrically connect each mating contact 20 to a corresponding mounting contact 58. The terminals 116 include the mating and mounting contacts 20 and 58, respectively, and an intermediate terminal portion 118, which extends between the mating and mounting contacts 20 and 58, respectively. The terminals 116 may be either signal terminals, ground terminals, or power terminals. In one embodiment, adjacent signal terminals may function as differential pairs, and each differential pair may be separated by a ground terminal.

As illustrated in FIG. 4, during manufacture, the lead frame 100 is attached to a carrier strip 120, which is removed and discarded after the over-molding process that creates the contact modules 50. During manufacture, the intermediate terminal portion 118 of the lead frame 100 is retained in place by securing members (not shown), also referred to as fingers. The securing members secure the lead frame 100 while the plastic body 102 is molded around and encloses the lead frame 100, such that the lead frame 100 is sandwiched between the first and second side surfaces 108 and 110. The voids 112, as illustrated in FIG. 3, are created by the securing members. For example, when the securing members are removed, the voids 112 remain in the body 102. In high speed applications, the voids 112 in the contact modules 50 lead to signal degradation, reflection, and signal loss, particularly of the high frequency signals. The voids 112 may also be referred to as pinch points.

Figure 5:
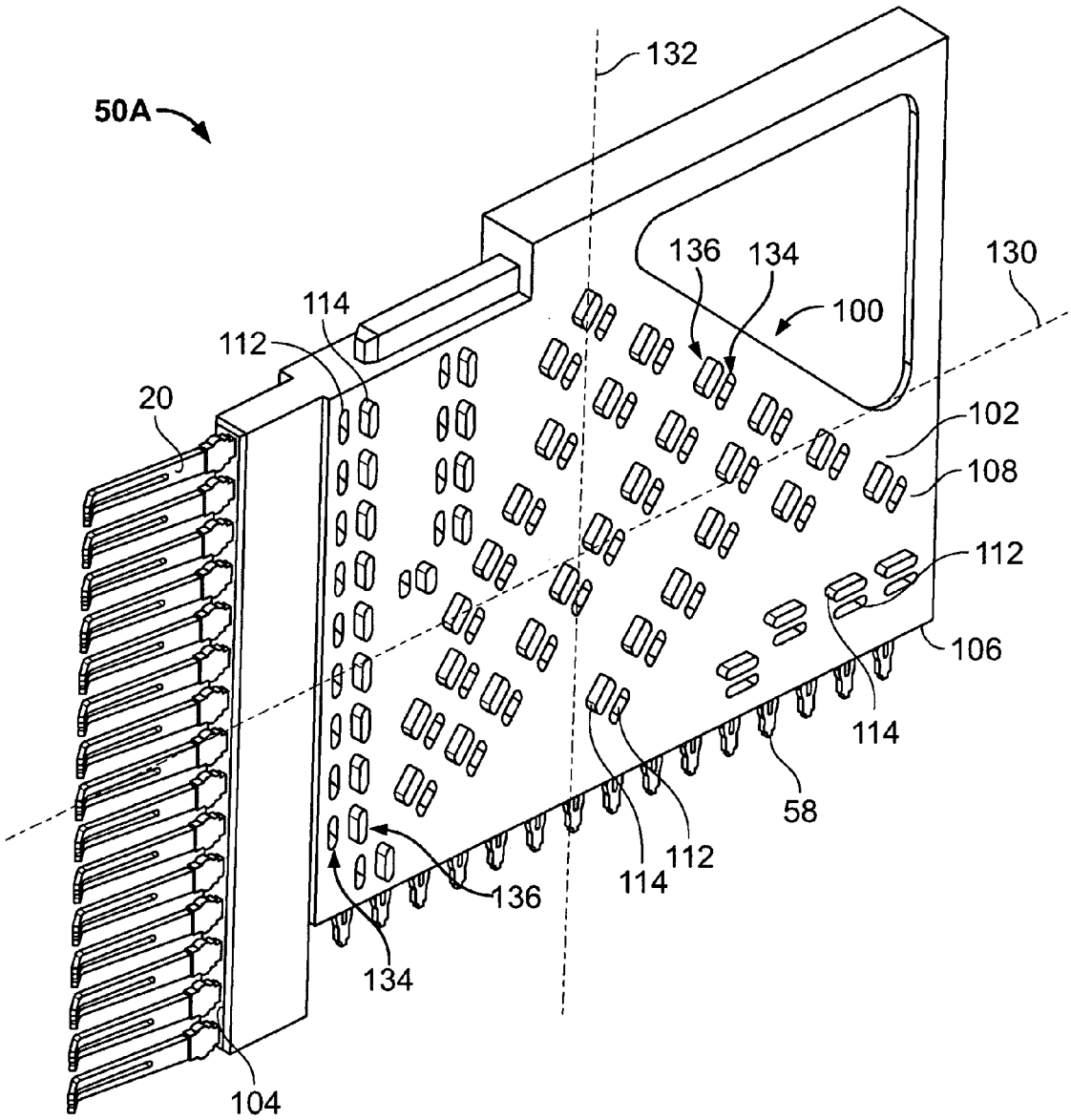
FIG. 5 is a side perspective view of the contact module shown in FIG. 3, having a first configuration of voids and protrusions.
Figure 6:
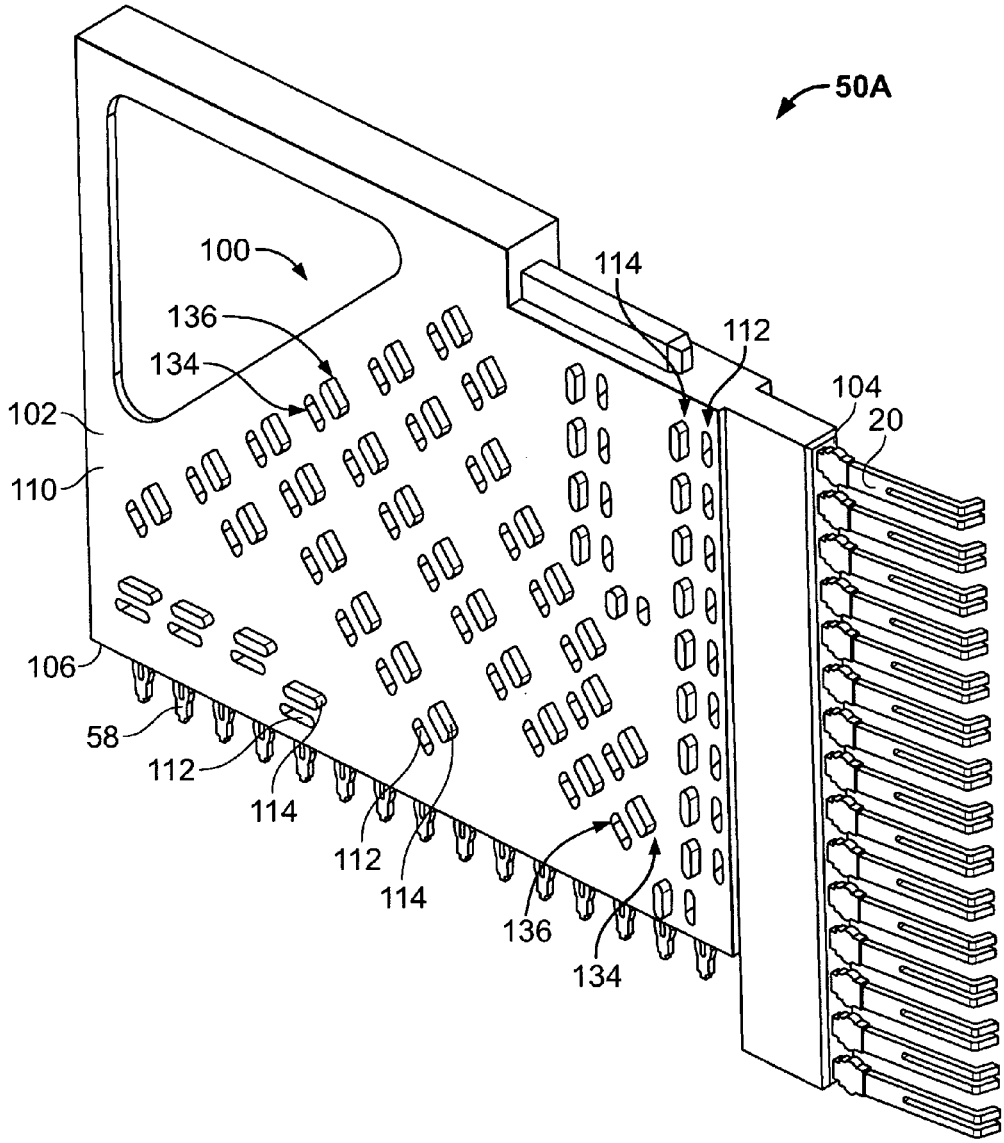
FIG. 6 is a side perspective view of the opposite side of the contact module shown in FIG. 5.

FIG. 5 illustrates a side perspective view of a contact module 50A having a first configuration, referred to hereinafter as configuration A, of voids 112 and protrusions 114 when viewed from the first side surface 108 of the body 102. FIG. 6 illustrates a side perspective view of the contact module 50A when viewed from the second surface 110 of the body 102. The contact module 50A includes a major or longitudinal axis 130 and a minor or lateral axis 132. The major and minor axes 130 and 132 are oriented substantially perpendicular to one another. In one embodiment, the mating edge 104 of the body 102 extends substantially parallel to the minor axis 132 and the mounting edge 106 of the body 102 extends substantially parallel to the major axis 130. As such, the contact module 50A illustrated in FIG. 5 may be referred to as a right angle contact module. However, other types and configurations of contact modules may be used, such as, for example, vertical or linear contact modules, double right angle contact modules, and the like. With respect to the contact module 50A illustrated in FIG. 5, the rows of mating and mounting contacts 20 and 58 also extend parallel to the minor and major axes 132 and 130, respectively. Along the path of the intermediate terminal portion 118, the terminal 116 extends parallel to, perpendicular to, and oblique with respect to the major axis 130.

As illustrated in FIGS. 5 and 6, the first and second side surfaces 108 and 110 of the contact module 50A, when viewed together, define a configuration or pattern of voids 112 and protrusions 114. The size and depth of the voids 112 and protrusions 114 are selected such that, when assembled, each protrusion 114 is received within a corresponding void 112 of an adjacent contact module. As such, the protrusions 114 facilitate at least partially, and in some embodiments, completely filling the voids 112 when the adjacent contact modules are mated or nested with one another, or loaded into the housing 12 of the electrical connector 10 (shown in FIG. 1).

The orientation of the voids 112 are selected in a predetermined pattern such that the lead frame 100 (shown in FIGS. 3 and 4) is supported and secured by the securing members during the over-molding process. For example, in one embodiment, each terminal 116 (shown in FIG. 3) is generally secured between approximately two and approximately ten securing members, depending upon the length of the terminal 116. As a result, each terminal 116 has between approximately two and approximately ten voids 112. However, more or less securing members may be used to secure the terminals 116, and thus more or less voids 112 could be included along the length of the terminal 116. The voids 112 are arranged in rows 134, such that the voids 112 are substantially aligned with one another. Optionally, the rows 134 may extend substantially parallel to the major axis 130. The rows 134 may also extend substantially perpendicular to the major axis 130. The rows 134 may also extend oblique with respect to the major axis 130. Alternatively, the voids 112 may be arranged in a random configuration along the first and second side surfaces 108 and 110. In one embodiment, the rows 134 of voids 112 extend substantially perpendicular to the path of the terminals 116. At least some of the rows 134 may extend across each terminal 116 such that a void 112 is provided in a row 134 across the width of the lead frame 100.

The protrusions 114 are also arranged in a predetermined pattern. In one embodiment, the pattern of protrusions 114 is complementary or related to the pattern of voids 112. For example, a substantially equivalent number of protrusions 114 and voids 112 may be provided. The protrusions 114 may be arranged in rows 136 which are off-set in a predetermined pattern or location as compared to the voids 112. For example, the rows 136 may be off-set in a direction substantially parallel to the major axis 130. The rows 136 may be off-set in a direction substantially perpendicular to the major axis 130. The rows 136 may be off-set in an oblique direction with respect to the major axis 130. Alternatively, the protrusions 114 may be arranged in a random configuration along the first and second side surfaces 108 and 110. In one embodiment, the rows 136 of protrusions 114 extend substantially perpendicular to the path of the terminals 116. At least some of the rows 136 may extend across each terminal 116 such that a protrusion 114 is provided in a row 136 across the width of the lead frame 100.

As illustrated in FIGS. 5 and 6, the voids 112 and protrusions 114 have a first configuration, or configuration A. Configuration A is shown for illustrative purposes only, and other configurations may be used in other embodiments. Configuration A has rows 134 of voids 112 extending parallel to, perpendicular to, and obliquely with respect to the major axis 130. Configuration A also has rows 136 of protrusions 114 generally away from or rearward, with respect to the mating edge 104, of the rows 134 of voids 112 extending perpendicular to the major axis 130. Configuration A also has rows 136 of protrusions 114 generally away from, with respect to the mounting edge 106, the rows 134 of voids 112 extending parallel to the major axis 130. Configuration A also has rows 136 of protrusions 114 obliquely off-set with respect to the rows 134 of voids 112 extending obliquely with respect to the major axis 130.

The first and second side surfaces 108 and 110 are substantially similar. For example, the voids 112 on each surface 108 and 110 are substantially aligned with one another and the protrusions 114 on each surface 108 and 110 are substantially aligned with one another. As a result, contact modules 50A having configuration A can not be nested with one another. For example, when contact modules 50A are placed adjacent to one another, voids 112 on the first side surface 108 are aligned with voids 112 on the second side surface 110 of the adjacent contact module 50A. Similarly, protrusions 114 on the first side surface 108 are aligned with protrusions 114 on the second side surface 110 of the adjacent contact module 50A. The modules 50A can not be nested with one another. However, contact modules 50A may be nested with other contact modules 50, as will be described in detail below.

Figure 7:
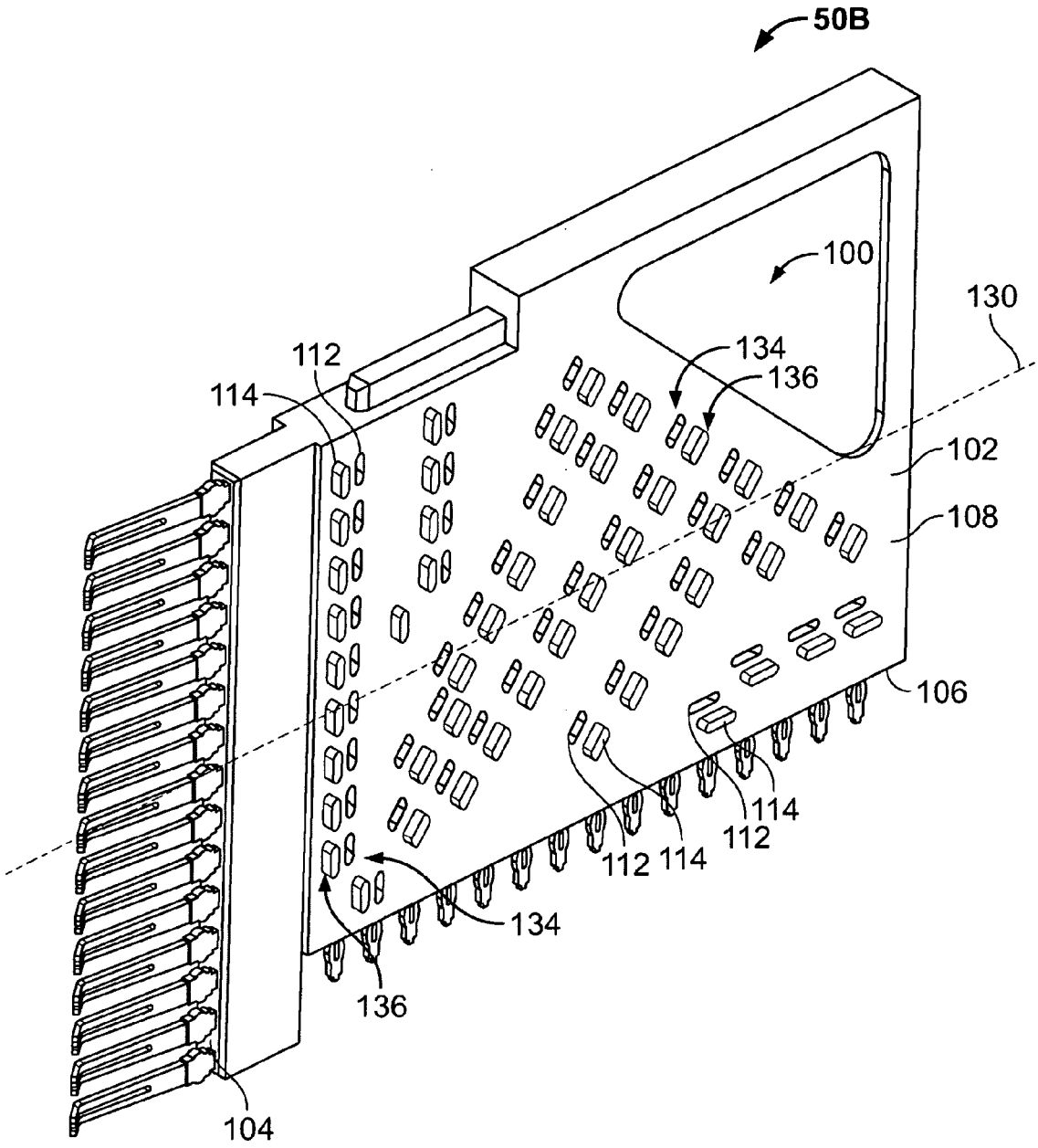
FIG. 7 is a side perspective view of another contact module having a second configuration of voids and protrusions.
Figure 8:
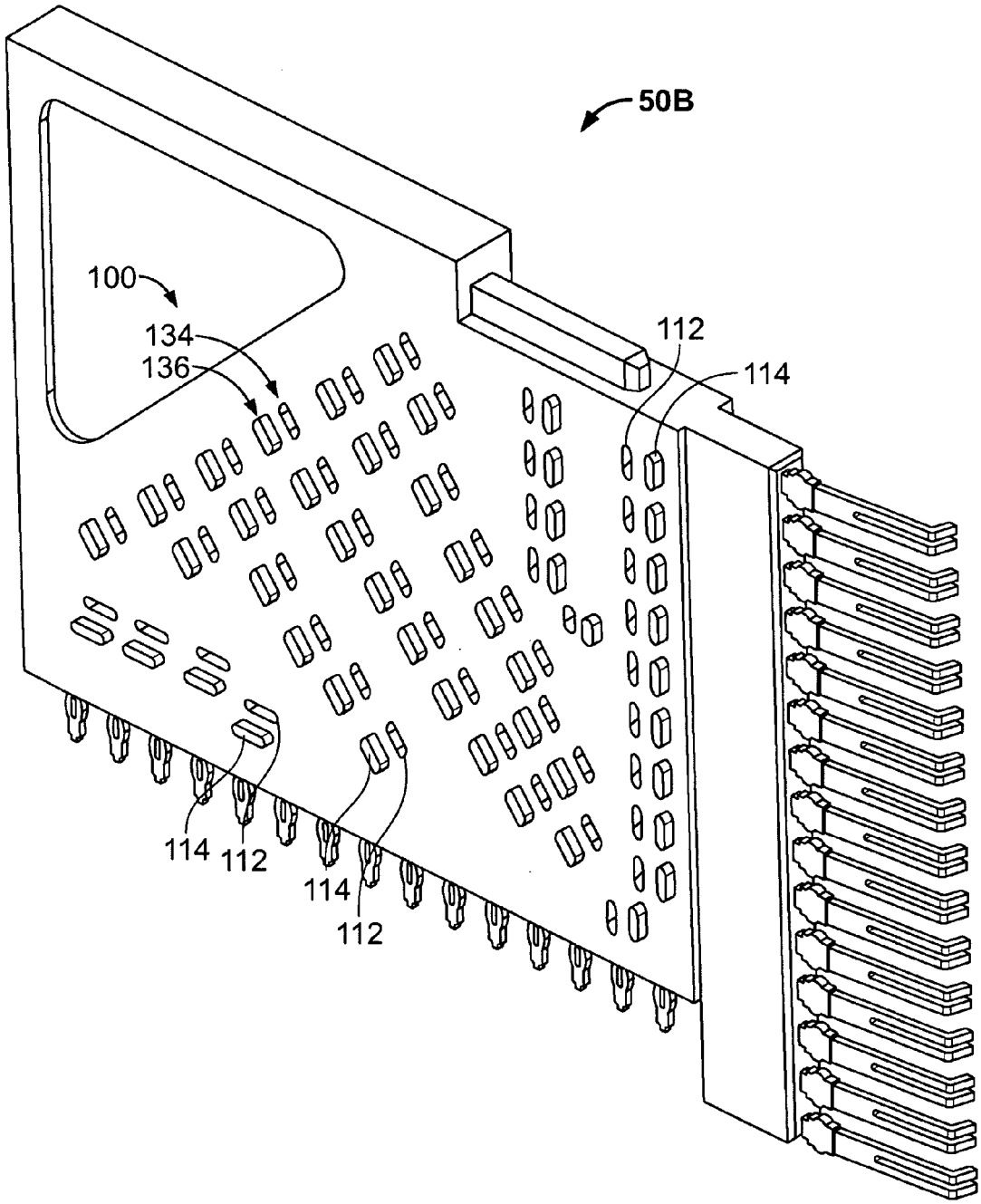
FIG. 8 is a side perspective view of the opposite side of the contact module shown in FIG. 7.

FIG. 7 illustrates a side perspective view of another contact module 50B having a second configuration, referred to hereinafter as configuration B, of voids 112 and protrusions 114 when viewed from the first side surface 108 of the body 102. FIG. 8 illustrates a side perspective view of the contact module 50B when viewed from the second side surface 110 of the body 102. In an exemplary embodiment, configuration B is related to configuration A, in that configurations A and B are complementary to one another. Configuration B is shown for illustrative purposes only, and other configurations may be used in other embodiments.

Configuration B has rows 134 of voids 112 extending parallel to, perpendicular to, and obliquely with respect to the major axis 130. Configuration B also has rows 136 of protrusions 114 generally forward of, with respect to the mating edge 104, the rows 134 of voids 112 extending perpendicular to the major axis 130. Configuration B also has rows 136 of protrusions 114 generally away from, with respect to the mounting edge 106, the rows 134 of voids 112 extending parallel to the major axis 130. Configuration B also has rows 136 of protrusions 114 obliquely off-set with respect to the rows 134 of voids 112 extending obliquely with respect to the major axis 130.

The first and second side surfaces 108 and 110 are substantially similar to one another. For example, the voids 112 on each surface 108 and 110 are substantially aligned with one another and the protrusions 114 on each surface 108 and 110 are substantially aligned with one another. As a result, contact modules 50B having configuration B can not be nested with one another. However, the arrangement of the voids 112 and protrusions 114 of configuration B are such that, when the contact module 50B is positioned proximate contact module 50A (shown in FIGS. 5 and 6), each of the voids 112 is substantially aligned with a corresponding protrusion 114. As a result, contact modules 50A and 50B are configured to be nested with one another.

As illustrated with reference to FIGS. 1 and 5-8, the contact modules 50A and 50B are nested with one another and loaded into the housing 12 of the electrical connector 10. Alternatively, the contact modules 50A and 50B may be loaded into the housing 12 one at a time in a predetermined sequence. During assembly, the contact modules 50A and 50B are aligned with one another such that the planar side surfaces 108 and 110 of adjacent contact modules 50A and 50B are proximate one another and face one another. Optionally, the surfaces 108 and 110 may abut one another when nested. During mating, the protrusions 114 of the first side surface 108 of contact module 50A are at least partially inserted into the voids 112 of the second side surface 110 of contact module 50B. Similarly, the protrusions 114 of the second side surface 110 of the contact module 50B are at least partially inserted into the voids 112 of the first side surface 108 of the contact module 50A. Additionally, during mating, the protrusions 114 of the first side surface 108 of contact module 50B are at least partially inserted into the voids 112 of the second side surface 110 of contact module 50A. Similarly, the protrusions 114 of the second side surface 110 of contact module 50A are at least partially inserted into the voids 112 of the first side surface 108 of contact module 50B. In one embodiment, the protrusions 114 are dimensioned or sized to create a friction fit with the corresponding voids 112. Optionally, the friction fit allows the contact modules 50A and 50B to be nested together for loading into the housing 12. Once a predetermined number of contact modules 50A and 50B are nested with one another, the unit is loaded into the housing 12 of the connector 10.

Figure 9:
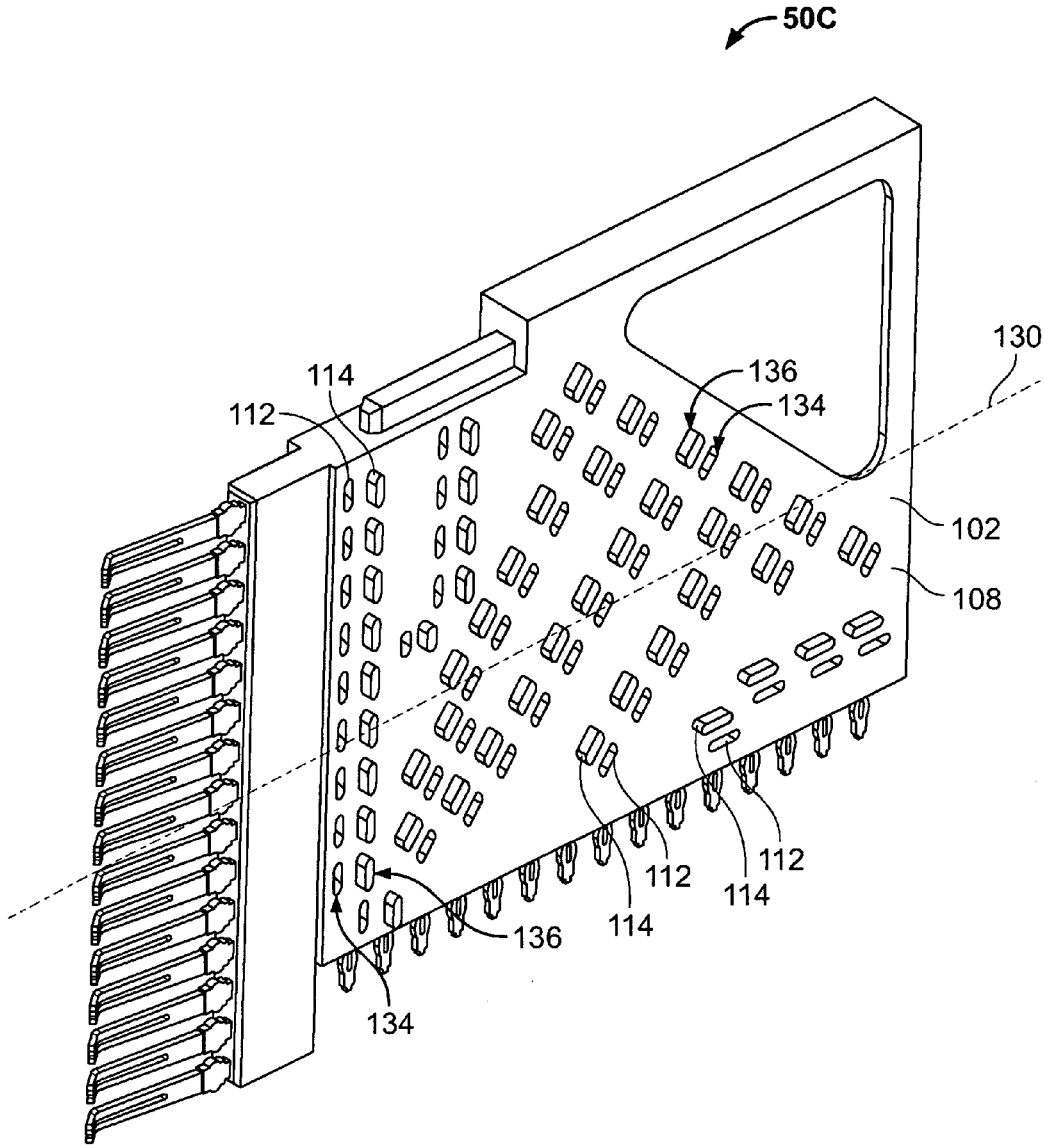
FIG. 9 is a side perspective view of a further contact module having a third configuration of voids and protrusions.
Figure 10:
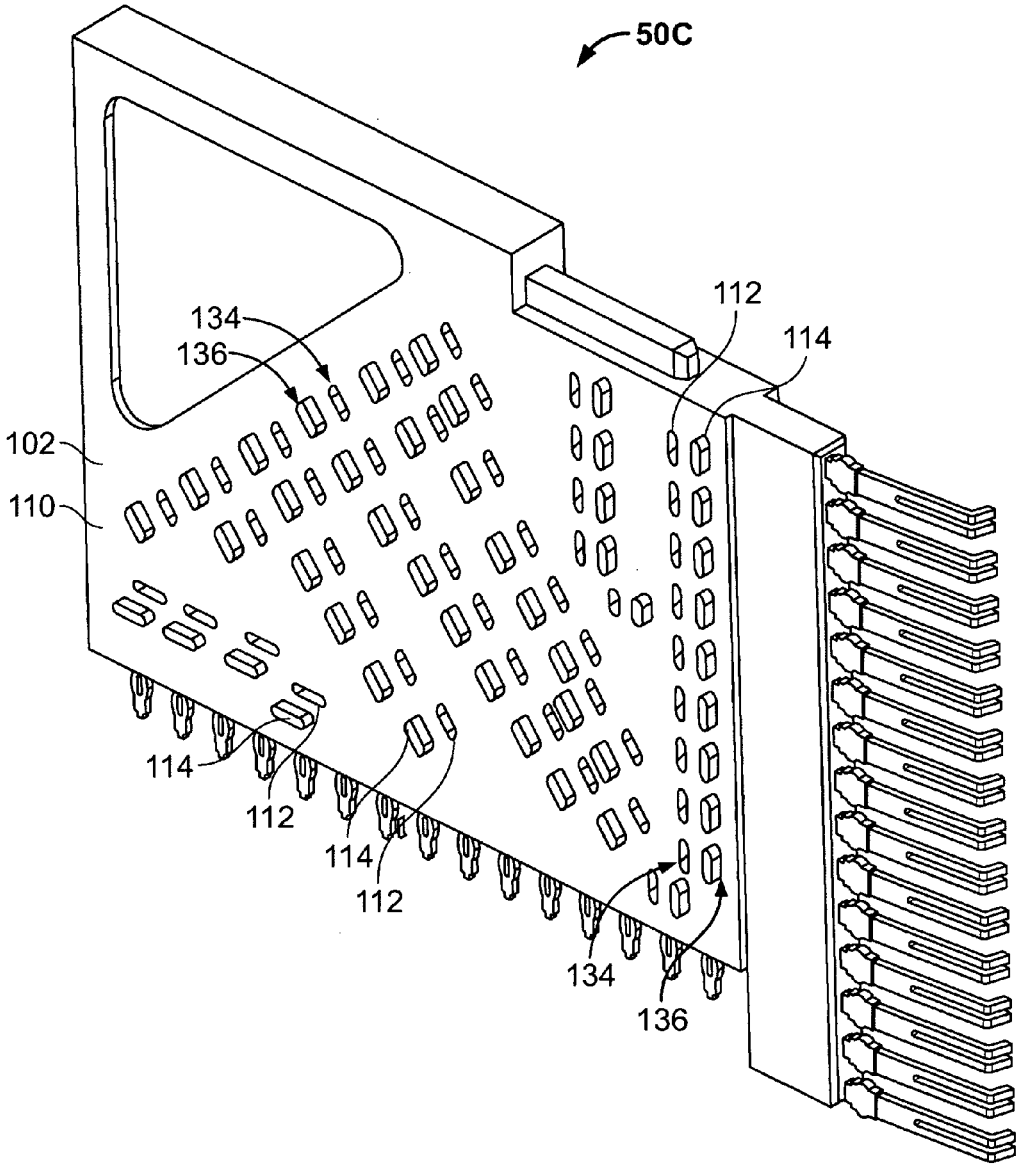
FIG. 10 is a side perspective view of the opposite side of the contact module shown in FIG. 9.

FIG. 9 is a side perspective view of a further contact module 50C having a third configuration, referred to hereinafter as configuration C, of voids 112 and protrusions 114 when viewed from the first side surface 108 of the body 102. Configuration C is shown for illustrative purposes only, and other configurations may be used in other embodiments. FIG. 10 illustrates a side perspective view of the contact module 50C when viewed from the second side surface 110 of the body 102. Multiple contact modules 50C are nested with one another and loaded into the housing 12 to form the electrical connector 10 (shown in FIG. 1).

Configuration C has rows 134 of voids 112 extending parallel to, perpendicular to, and obliquely with respect to the major axis 130. Configuration C also has rows 136 of protrusions 114 extending parallel to, perpendicular to, and obliquely with respect to the major axis 130. The rows 136 of protrusions 114 correspond and are related to the rows 134 of voids 112. In one embodiment, the first surface 108 includes voids 112 but does not include any protrusions 114, and the second surface 108 includes protrusions 114, but does not include any voids 112.

The contact module 50C differs from contact modules 50A and 50B (shown in FIGS. 5-6 and 7-8, respectively) in that the first and second side surfaces 108 and 110 of the contact module 50C have a different pattern of voids 112 and protrusions 114 with respect to one another. For example, the voids 112 on the first surface 108 are substantially aligned with the protrusions 114 on the second surface 110. Similarly, the voids 112 on the second surface 110 are substantially aligned with the protrusions 114 on the first surface 110. As a result, during mating, the contact modules 50C having configuration C can be nested with one another. For example, when the first surface 108 of the contact module 50C is aligned with the second surface 110 of the contact module 50C, each of the voids 112 is aligned with each of the protrusions 114. As a result, only one type of molded contact module 50 is required to form the electrical connector.

Figure 11:
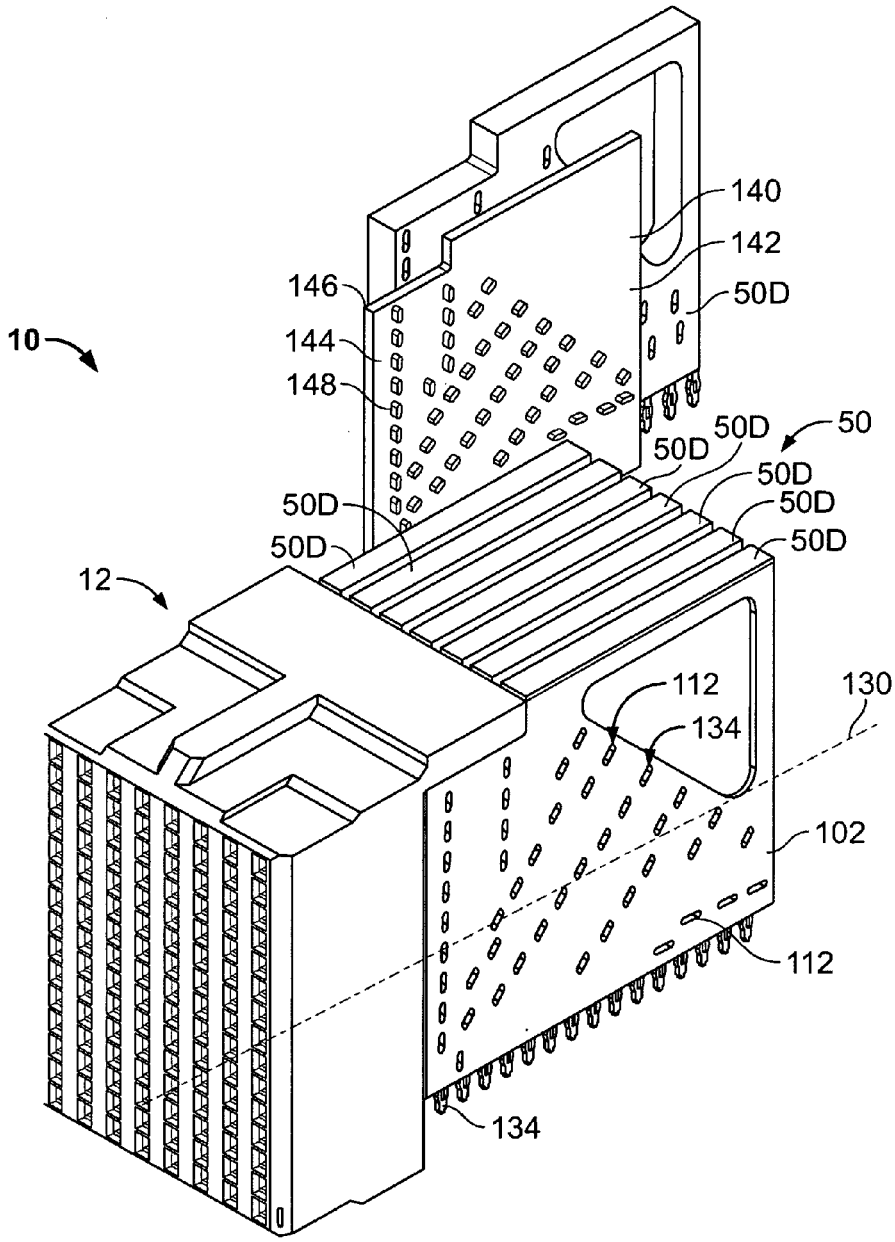
FIG. 11 is a perspective view of another electrical connector assembled using another embodiment of a contact module.

FIG. 11 is a perspective view of an electrical connector 10 assembled using contact modules 50D, having a fourth configuration, referred to hereinafter as configuration D, of voids 112.

Configuration D has rows 134 of voids 112 extending parallel to, perpendicular to, and obliquely with respect to the major axis 130. In contrast to configurations A-C (shown in FIGS. 5-10), the contact module 50D does not include any protrusions extending from the body 102. As a result, the contact modules 50D may be manufactured in a cost effective manner by using a simple molding process.

The electrical connector 10 includes insert members 140 having a planar body 142 that includes a first surface 144 and a second surface 146. The insert member 140 includes protrusions 148 extending from the first and second surfaces 144 and 146. The protrusions 148 are arranged in a predetermined pattern corresponding to the pattern of voids 112 on the contact modules 50D. In one embodiment, the insert member 140 may be fabricated using a molding process.

During assembly, the insert member 140 is positioned between adjacent contact modules 50D such that the protrusions 148 at least partially fill the voids 112. In one embodiment, the insert members 140 and contact modules 50D are assembled prior to loading into the housing 12. Alternatively, the insert members 140 and contact modules 50D may be loaded sequentially. In another alternative embodiment, the insert members 140 may be integrally formed with the housing 12 and the contact modules 50D may be loaded between the insert members 140.

The embodiments herein described provide an electrical connector 10 having improved electrical characteristics as compared to electrical connectors having contact modules with un-plugged or un-filled voids. The connector 10 includes a plurality of contact modules 50 having various configurations of voids 112 and/or protrusions 114 for filling the voids 112 when the contact modules 50 are arranged in the housing 12. Optionally, a separate member 140 may be positioned between adjacent modules 50 to fill the voids 112 in the modules 50. The protrusions 114 allows the connector 10 to operate at higher frequencies with increased throughput.

While the invention has been described in terms of various specific embodiments, those skilled in the art will recognize that the invention can be practiced with modification within the spirit and scope of the claims.

What is claimed is:

1. An electrical connector comprising:

a housing; and first and second contact modules mounted proximate one another in said housing;

said first and second contact modules each comprising a mating edge and a mounting edge, said first and second contact modules each comprising a lead frame having terminals extending between said mating edge and said mounting edge, said first and second contact modules each encasing corresponding said terminals, and said first and second contact modules each having contact side surfaces that face one another when mounted in said housing;

wherein said side surface of said first contact module includes a void positioned therein and exposing said lead frame and a protrusion extending outward therefrom, and said side surface of said second contact module includes a void positioned therein and exposing said lead frame and a protrusion extending outward therefrom, said voids and said protrusions being oriented such that said protrusions are received in corresponding ones of said voids when said first and second contact modules are mounted in said housing.

2. The electrical connector of claim 1, wherein said side surfaces are aligned in parallel planes, said protrusions extending perpendicular to said parallel planes.

3. The electrical connector of claim 1, further comprising multiple voids in and multiple protrusions on said side surface of said first contact module and multiple voids in and multiple protrusions on said side surface of said second contact module, wherein most of said voids are substantially filled by corresponding ones of said protrusions.

4. The electrical connector of claim 3, said multiple voids being positioned along an axis that is aligned at an acute angle with respect to at least one of said mating edge and said mounting edge.

5. The electrical connector of claim 1, said side surfaces abut against one another.

6. The electrical connector of claim 1, wherein each said protrusion engages said lead frame when received within said respective void.

7. The electrical connector of claim 1, wherein said voids and said protrusions are elliptical in shape.

8. The electrical connector of claim 1, wherein said side surface of said first contact module comprises a set of voids and a set of protrusions arranged in a first pattern, said side surface of said second contact module comprises a set of voids and a set of protrusions arranged in a second pattern that is different than the first pattern.

9. The electrical connector of claim 1, wherein said first contact module comprises opposed first and second side surfaces, said second contact module comprises opposed first and second side surfaces, each said first side surface comprising a set of voids and a set of protrusions arranged in a first pattern, each said second side surface comprising a set of voids and a set of protrusions arranged in a different second pattern, said first side surface of said first contact module facing said second side surface of said second contact module such that each said void is substantially filled by a corresponding said protrusion when said contact modules are mounted within said housing.

10. The electrical connector of claim 1, wherein said first contact module comprises opposed first and second side surfaces, said second contact module comprises opposed first and second side surfaces, said first and second side surfaces of said first contact module comprising a set of voids and a set of protrusions arranged in a first pattern, said first and second side surfaces of said second contact module comprising a set of voids and a set of protrusions arranged in a different second pattern that complements the first pattern, said electrical connector comprising a plurality of first contact modules and a plurality of second contact modules mounted within the housing and arranged in an alternating sequence such that the voids of the first contact module are filled by the protrusions of the second contact module and the voids of the second contact module are filled by the protrusions of the first contact module.

11. An electrical connector comprising:

a housing;

contact modules mounted in said housing, each said contact module comprising a mating edge and a mounting edge, each said contact module comprising a lead frame having terminals extending between said mating edge and said mounting edge, each said contact module encasing corresponding said terminals, each said contact module comprising a contact side surface having a plurality of voids positioned therein and exposing said lead frame; and an insert member comprising opposed side surfaces each having a plurality of protrusions extending outward therefrom, said insert member being devoid of terminals, wherein said insert member is positioned between adjacent contact modules such that each said protrusion is received in a corresponding said void when said contact modules and said insert member are mounted in said housing.

12. The electrical connector of claim 11, wherein said insert member is formed integrally with said housing.

13. The electrical connector of claim 11, wherein each said contact side surface and said opposed side surfaces of said insert member are aligned in parallel planes, said protrusions extending perpendicular to said parallel planes, and each said contact side surface abuts against a corresponding said side surface of said insert member.

14. The electrical connector of claim 11, wherein said insert member comprises a lead frame.

15. The electrical connector of claim 14, wherein said voids are arranged in a first pattern and said protrusions are arranged in a complementary second pattern such that said protrusions fill said voids when mourned in said housing.

* * * * *